US007462043B2

(12) United States Patent
Deisenhofer

(10) Patent No.: US 7,462,043 B2
(45) Date of Patent: Dec. 9, 2008

(54) ELECTRICAL CONNECTOR ELEMENT

(75) Inventor: Günter Deisenhofer, Augsburg (DE)

(73) Assignee: GE Fanuc Embedded Systems, Inc., Charlottesville, VA (US)

( * ) Notice: Subject to any disclaimer, the term of this patent is extended or adjusted under 35 U.S.C. 154(b) by 0 days.

(21) Appl. No.: 11/611,586

(22) Filed: Dec. 15, 2006

(65) Prior Publication Data

US 2008/0146074 A1 Jun. 19, 2008

(51) Int. Cl.
*H01R 4/66* (2006.01)

(52) U.S. Cl. ..... 439/97; 439/801; 439/883; 439/868; 411/149; 411/150; 411/166; 411/187; 411/188

(58) Field of Classification Search ..... 439/97, 439/801, 883, 868; 411/149, 150, 166, 187, 411/188
See application file for complete search history.

(56) References Cited

U.S. PATENT DOCUMENTS 2,897,472 A * 7/1959 O'Brien ..... 439/738
4,842,463 A * 6/1989 Landt ..... 411/188
6,435,788 B2 * 8/2002 Reed ..... 411/178
7,014,406 B2 * 3/2006 Robertson ..... 411/161

* cited by examiner

*Primary Examiner*—Tho D Ta
(74) *Attorney, Agent, or Firm*—GE Global Patent Operation

(57) ABSTRACT

An aluminum enclosure of an electronic device is used in a corrosion environment. A long-term low impedance ground connection is needed because of security and EMC reasons. While common surface protection for aluminum in corrosion environments as for example polyurethane paint is not conductive, a stainless steel connector is provided which comprises a head portion and a bolt portion. The bolt portion is inserted into a bore of the enclosure or frame. An annular rib provided on the back side of the head portion defines a cutting edge which cuts into the surface of the aluminum enclosure and provides a gas-tight electrical contact. The front surface of the stainless steel head of the electrical connector element provides a metallic surface for connecting ground wires or other conductors.

16 Claims, 2 Drawing Sheets

ELECTRICAL CONNECTOR ELEMENT

BACKGROUND OF THE INVENTION

The present invention relates generally to the field of electrical connectors and specifically to an electrical connector element for connecting frames or casings of electrical apparatuses such as computers or the like to other electrical conductors, electrical leads or wires, in particular ground leads. Moreover, the invention relates to an electrical connector assembly comprising the inventive connector element and a method for providing an electrical contact surface.

Electrical apparatuses, e.g. computers or the like, are very often used in military, civil or industrial environments in stationary applications, on board of vessels, ships, aircrafts or the like. The electrical equipment may be used in unfriendly or even corrosion environment by being exposed to salt, water, humid atmosphere, sea water spray, acids and the like. Nonetheless, electrical connections, in particular ground connections of housings, frames or the like which are prone to corrosion attacks, have to be reliable on the long run. Any increase of the electrical contact resistance of the ground connection may cause personal hazards for operators and personnel and jam operation of the unit in question and of other devices of the equipment.

It is an object of the invention to provide an electrical connector element in particular for making frame connections on frames or casings of electrical apparatuses which connector element will provide an electrical contact surface for making long-term reliable electrical connections.

Moreover it is an object of the invention to provide a contact assembly for electrically connecting a lead to a frame or casing of an electrical apparatus which assembly will provide long-term reliable electrical connection.

Moreover it is an object of the invention to provide a method for providing an electrical corrosion resistant contact surface on a frame or casing of an electrical apparatus.

SUMMARY OF THE INVENTION

One embodiment of the invention relates to an electrical connector element in particular for making electrical frame connections on frames or casings of electrical apparatuses. The electrical connector element comprises a corrosion resistant body having a head portion of a first diameter, a front surface, a back surface and threaded bolt of a second diameter. The threaded bolt protrudes from the back surface and defines a longitudinal axis. The diameter of the head portion is larger than the diameter of the threaded bolt. At least one annular contact rib is provided on the back surface. The at least one annular rib protrudes in axial direction and surrounds the threaded bolt while being located coaxially to the longitudinal axis. At least one threaded bore extends from the front surface into the head portion. The threaded bore may receive a connector screw for clamping a contact element against the metallic front surface. The front surface provides a corrosion resistant contact face irrespective the material the housing or frame is made of.

The connector element may be inserted into a bore of a frame or housing in order to provide a means for electrically connecting cables or wires in particular ground wires to the frame or housing. The connector element is tightened so that the contact rib cuts into the surface of the frame or housing and plastically deforms the metallic material thereof in a circular zone. The housing or frame may in particular consist of aluminum or other metals which require a coating for protection against corrosion attack. While paint may provide corrosion protection for the frame or housing, the connector element and in particular the metallic front surface thereof will provide a contact surface which is less prone to corrosion.

The at least one annular rib penetrates the surface of the frame or housing and provides a gas-tight interface. This gas-tight interface will provide a long-term low resistance electrical connection between the connector element and the frame or housing. It is preferred to cover the interface by a non-metallic protective layer, e.g. paint or the like. This will increase the reliability of the electrical contact.

A preferred embodiment of the invention relates to an electrical connector element, wherein the threaded bore extends from the front surface into the body. Moreover, it is preferred to coaxially align the threaded bolt portion and the threaded bore. The threaded bore may extend through the head portion into the bolt portion. The threaded bore is preferably a dead hole. Consequently, the threaded bore does not provide any channel from outside to the interior of the frame or housing, the connector element is mounted on, irrespective whether a clamping screw closes the threaded bore or not.

Another embodiment of the invention relates to an electrical connector element as discussed above, wherein the front surface is planar. Different shapes of electrical wire connectors may be clamped against the planar front surface by the clamping screw in order to provide a long-term reliable low resistance electrical connection.

Another embodiment of the invention relates to an electrical connector element as discussed above, wherein the contact rib comprises an annular cutting edge. The cutting edge is preferably triangular in cross-section and uniform along its entire circumference. It contributes to the reliability of the electrical contact between the connector element and the frame or housing by cutting through the surface and coatings, if any, and digging into the metallic material of the frame or housing when tightening the electrical connector element. The cutting edge will easily provide the desired gas-tight interface. The gas-tight interface provides a very low electrical resistance from the connector element to the frame or housing and vice versa. This is because of the large contact area between, and the direct inter-metallic engagement of, the rib and the frame or housing. This is true in spite of the rather low specific conductivity of stainless steel which is the most preferred material for the connector. The gas-tight seal will also prevent corrosions from creeping through the interface and the bore the connector element is located in into the interior of the respective frame or housing.

The electrical connector element is preferably provided with a means for applying torque for tightening the connector element. Facets, in particular when provided on the circumferential surface of the head portion, may be used for applying a wrench or other tools for tightening the connector element.

The back surface encircled by the contact rib may be planar or be provided with a serration. The latter in combination with a serrated lock washer provides a means for preventing counter rotation of the electrical wire connector during and after tightening. This may be particularly useful if it is expected that the clamping screw will have to be unscrewed and removed any time. The counter rotation preventing means will make sure that any torque applied to the clamping screw for loosening it will break loose the clamping screw without counter rotating and unsettling the connector element.

Another embodiment of the invention relates to an electrical wire connector arrangement comprising the inventive electrical connector element, a clamping screw and an electrical wire connector.

Another embodiment of the invention relates to a method for providing an electrical contact surface on a frame or housing of an electrical apparatus. The inventive method comprises the steps of providing a frame or housing having a metallic surface and a bore therein. The metallic surface is at least large enough for receiving the connector element. The frame or housing may be completely free of paint or other coatings during this stage. Alternatively, the frame or housing may be partially or completely coated with a non-metallic coating with a small surface area left without coating or the coating removed therefrom. After inserting and tightening the connector, paint or other coating may be applied around the connector element while the contact surface of the corrosion resistant connector will remain without painting. This can be done by applying an adhesive foil to the contact surface before coating the arrangement and by removing the foil after the coating process.

The invention removes any need for applying an electrically conductive but corrosion-resistant coating to the aluminum frame or housing as there is e.g. a nickel-plating which was used earlier.

Embodiments of the invention will now be described by way of example with reference to the accompanying drawings.

DETAILED DESCRIPTION OF THE INVENTION

Figure 1:
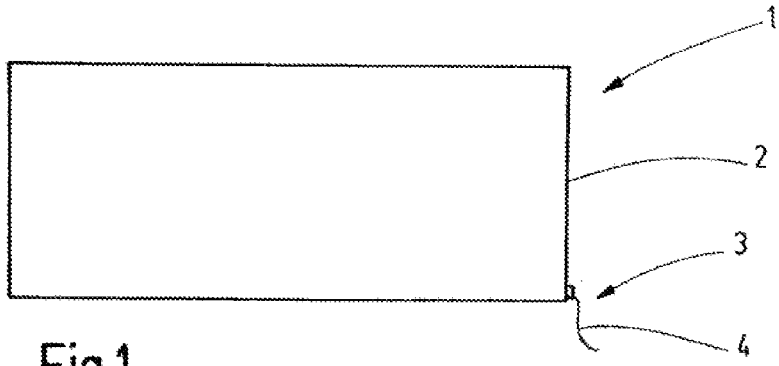
FIG. 1 is a schematic view of an electrical apparatus comprising the inventive connector element.

FIG. 1 illustrates an electrical apparatus 1 which may be e.g. a computer, a radio or any other electronic device. It may be part of the equipment of a civil or military vessel or aircraft or land-based vehicle. It may be also part of stationary equipment for civil or military use. In particular, apparatus 1 may be used in chemically aggressive, e.g. corrosion environment. Apparatus 1 comprises a housing 2 comprising an electrical ground connector 3. Ground connector 3 electrically connects a ground lead 4 to the housing 2.

Figure 2:
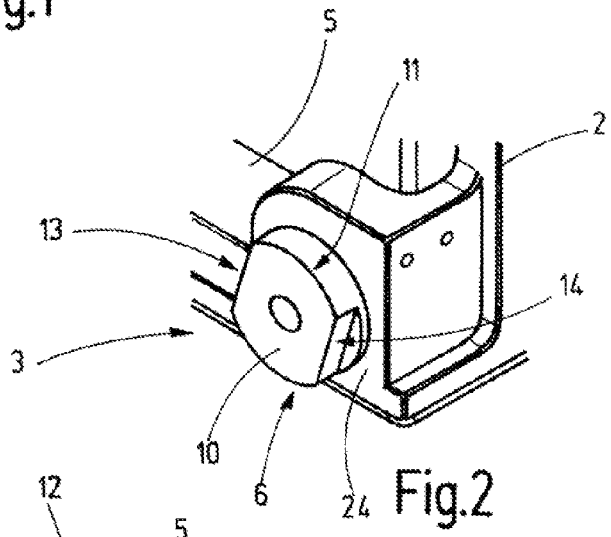
FIG. 2 is a perspective partial view of a corner portion of the apparatus of FIG. 1, illustrating the connector element when applied to the apparatus.

FIG. 2 illustrates details of the portion of casing 2 on which the ground connector 3 is mounted. A frame 5 may be provided in or around the casing 2. The casing 2 and/or the frame 5 may be made of aluminum or any other metal. In particular, casing 2 and/or frame 5 may be made of a light weight material prone to corrosion.

The ground connector 3 comprises an electrical connector element 6 which is inserted into a hole 7 provided in the casing 2 or frame 5. The hole 7 is preferably a threaded bore which extends through a portion of casing 2 or frame 5.

The ground connector 3 comprises a body which preferably consists of a corrosion resistant metallic material, e.g. stainless steel. The metallic body comprises a preferably plate or disc shaped head portion 8 and a bolt portion 9 extending therefrom. The bolt portion 9 is integrally formed in one piece with the connector element 6 and provided with a thread which matches to the thread of the hole 7.

The head 8 comprises preferably a planar front surface 10, a circumferential surface 11 and a back surface 12 surrounding the bolt portion 9. Preferably the circumferential surface 11 is mainly cylindrical and defines a first diameter which is considerably larger than the diameter of the bolt 9. The circumferential surface 11 may be provided with facets 13, 14 which preferably are parallel to one another. Facets 13, 14 are adapted to receive the prongs of a wrench which may be used for tightening the connector element 3 on the casing 2 or the frame 5.

The head and bolt portions 8 and 9 preferably define a longitudinal axis 15 to which they both are coaxially aligned.

Figure 3:
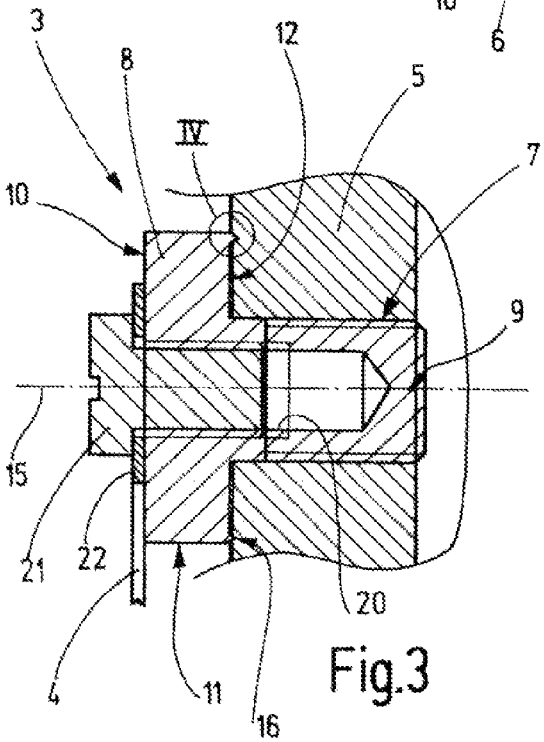
FIG. 3 is a view in cross-section of FIG. 2 taken along the longitudinal axis of the connector element.
Figure 4:
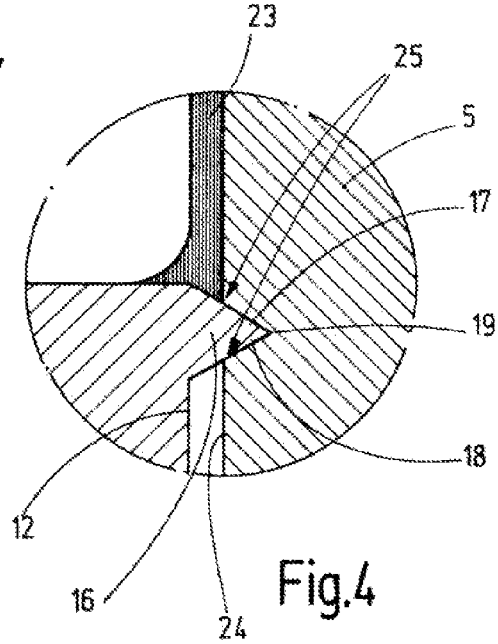
FIG. 4 is the enlarged detail IV of FIG. 3.

An annular rib 16 is provided on the back surface 12 as is to be taken from FIGS. 3 and 4 in particular. The annular rib 16 extends uninterruptedly around the back surface 12 in circumferential direction. Preferably the rib 16 is arranged coaxially to the bolt portion 9 and to the axis 15. The cross section of the rib 16 is preferably triangular and uniform along the rib 16. It comprises two annular inclined side surfaces 17, 18 which merge on an annular cutting edge 19. The circular cutting edge 19 preferably defines a constant diameter which is about as large as the diameter of the head portion 8. The side surfaces 17, 18 are preferably inclined one to another defining an acute angle. The side surface 17 merges into the circumferential surface 11. If desired another rib (not shown) may be disposed on the back surface 12 coaxially to the rib 16.

As to be taken from FIG. 3, the connector element 6 is provided with a threaded bore 20 for receiving a clamping screw 21 which may be inserted into the threaded bore 20. The clamping screw 21 is adapted to clamp an electrical wire connector 22, eyelet or lug against the front surface 10. The wire connector 22 may be a metallic disc or washer which is connected to the ground wire 4.

For connecting the ground wire 4 on the casing 2 or the frame 5, at first the threaded bore 7 is provided. Before application coating in particular paint 23 to the outer surface 24 of the housing 2 or the frame 5, connector element 6 is screwed into the hole 7. By applying torque to the head portion 8, the connector element 8 will be tightened so that the cutting edge 19 cuts into the surface 24 by deforming the metal close to the rib 16. The rib 16 when intruding into the material of the casing 2 or the frame 5 creates an annular groove. The flanks 17, 18 and the cutting edge 19 define a gas-tight interface 25 to the frame 5. Even with no paint 23 applied no corrosion will occur between the cutting edge 19 and the frame 5.

After tightening the connector element 6 by force, paint 23 or any other corrosion resistant coating may be applied. This can be done in particular by covering the front surface 10 by means of a removable element like an adhesive tape. After applying of the paint 23 the adhesive tape may be removed. This will leave contact surface 10 as an exposed metallic surface which, however, is corrosion resistant because of the nature of the material of the head portion 8.

As may be taken from FIG. 4, paint 23 or any other non-metallic coating applied after tightening the connector element 6 will seal any gap between the connector element 6 and the casing 2 or the frame 5.

Figure 5:
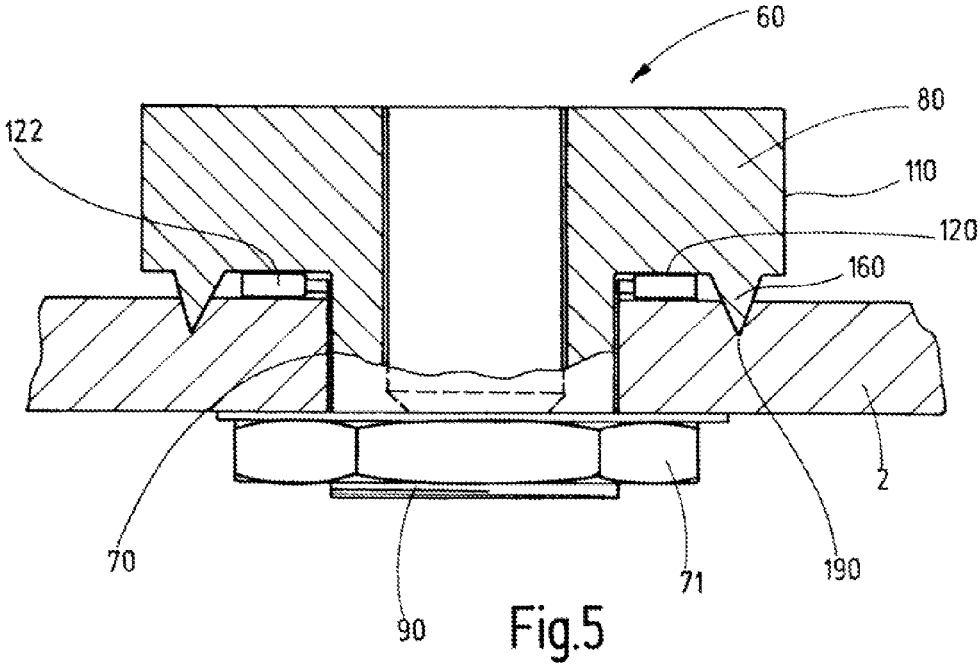
FIG. 5 is a cross-sectional view of an alternative embodiment of the inventive connector element.

FIG. 5 discloses another embodiment of a connector element 60 comprising a head portion 80 and a bolt portion 90. As illustrated, the connector element is mounted on a relatively thin wall of the casing 2. The bolt portion 90 extends through a bore 70 which may or may not be provided with a thread. A nut 71 is placed on the bolt portion 9 and tightened in order to draw the rib 160 into the material of the casing 2.

As to be seen from FIG. 5, the rib 160 comprises a pointed cutting edge 190 as described above. The rib 160 does not necessarily merge into the circumferential surface 110.

Figure 6:
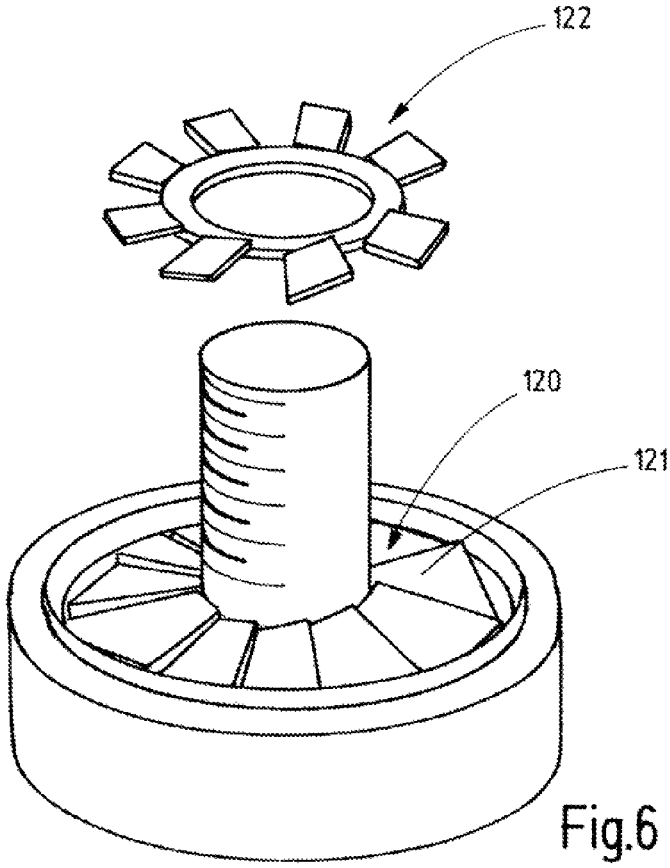
FIG. 6 is a perspective exploded view of the connector element of FIG. 5 and the serrated lock ring.

The back surface 120 may comprise a face serration 121 as to be taken from FIG. 6. A serrated lock washer 122 may be provided between the back surface 120 and the casing 2. The face serration 121 and the serrated lock ring will provide a means for preventing rotation of the connector element 60 when loosening any clamping screw for disconnecting the ground wire 4.

The serrated lock ring 122 is in particular useful in cooperation with connector elements which are inserted into screw bores.

An aluminum enclosure of an electronic device is used in a corrosion environment. A long-term low impedance ground connection is needed because of security and EMC reasons. While common surface protection for aluminum in corrosion environments as for example polyurethane paint is not conductive, a stainless steel connector is provided which comprises a head portion and a bolt portion. The bolt portion is inserted into a bore of the enclosure or frame. An annular rib provided on the back side of the head portion defines a cutting edge which cuts into the surface of the aluminum enclosure and provides a gas-tight electrical contact. The front surface of the stainless steel head of the electrical connector element provides a metallic surface for connecting ground wires or other conductors.

It is important to note that the construction and arrangement of the elements of the inventive connector system as shown in the preferred and other exemplary embodiments is illustrative only. Although only a certain number of embodiments have been described in detail in this disclosure, anyone skilled in the art will readily appreciate that many modifications are possible (e.g. variations in sizes, dimensions, structures, shapes and portions of the various elements, values of parameters, mounting arrangements, use of materials, orientations etc.) without materially departing from the teachings and advantages of the subject matter recited. For example, elements shown as integrally formed may be constructed of multiple parts or elements shown as multiple parts may be integrally formed. The operation of the assemblies may be reversed or otherwise varied. Length or width of the structures and/or members or connectors or other elements of the system may be varied. The nature or number of adjustment or attachment positions provided between the elements may be varied. It should be noted that the elements and/or assemblies of the system may be constructed from any of a wide variety of materials that provide sufficient strength or durability. Accordingly, all such modifications are independent to be included within the scope of the present disclosure. Other substitutions, modifications and changes may be made in the design, operating conditions and arrangement of the preferred and other exemplary embodiments without departing from the spirit of the present subject matter.

What is claimed is:

1. An electrical connector element (6) in particular for making frame connections on frames (5) or casings (2) of electrical apparatuses (1), comprising:

a corrosion resistant body having a head portion (8) of a first diameter, a front surface (10), a back surface (12) comprising a serration (121), and a threaded bolt portion (9) of a second diameter extending from the back surface (12) and aligned coaxial to a longitudinal axis (15);

said first diameter being larger than the second diameter;

an annular contact rib (16) provided on the back surface (12) protruding in axial direction and surrounding said threaded bolt (9);

said contact rib (16) being located coaxially to the longitudinal axis (15); and a threaded bore (20) extending into the head portion (8).

2. An electrical connector element according to claim 1, wherein the threaded bore (20) extends from the front surface (10) into the body and is coaxially aligned to the threaded bolt portion (9).

3. An electrical connector element according to claim 1, wherein the threaded bore (20) extends through the head portion (8) into the bolt portion (9).

4. An electrical connector element according to claim 1, wherein the threaded bore (20) is a dead hole.

5. An electrical connector element according to claim 1, wherein the front surface (10) is planar.

6. An electrical connector element according to claim 1, wherein the contact rib (16) comprises an annular cutting edge (19).

7. An electrical connector element according to claim 1, wherein the head portion (8) comprises a means (13, 14) for applying torque.

8. An electrical connector element according to claim 1, wherein the back surface (12) is planar.

9. An electrical connector element according to claim 1, wherein the contact rib (16) is triangular in cross section.

10. An electrical connector element according to claim 9, wherein the head (8) comprises at least one facet (13, 14) for applying a wrench.

11. An electrical connector assembly, comprising a connector element (6) according to claim 1, an electrical wire connector (22), and a clamping screw (21) securing the wire connector against the front surface (10).

12. An electrical wire connector assembly according to claim 11, further comprising a means (121, 122) for preventing rotation of the electrical connector element (60) in one direction while enabling rotation of the connector element in the opposite direction.

13. An electrical wire connector assembly according to claim 12, wherein the means (121, 122) for preventing rotation of the electrical connector element (60) in one direction while enabling rotation of the connector element in the opposite direction comprises a serrated lock washer (122).

14. Method for providing an electrical contact surface (10) on a frame (5) or a housing (2) of an electrical apparatus (1), comprising the steps of:

providing a frame (5) or housing (2) having a metallic surface and a bore (7) therein;

inserting the connector element (6) of claim 1 into the bore (7) and tightening it in order to press the contact rib (16) into the metallic surface by plastically deforming the metallic material of the frame (5) or housing (2);

applying a coating (23) on the frame (5) or housing (2) while leaving the front surface (10) of the head portion (8) free of coating.

15. Method according to claim 14, wherein the rib provides a gas-tight interface (25).

16. Method according to claim 14, wherein the coating (23) covers at least a portion of the circumferential surface (11) of the head portion (8).

* * * * *